US006478265B2

(12) United States Patent
Leach

(10) Patent No.: US 6,478,265 B2
(45) Date of Patent: Nov. 12, 2002

(54) POST MOUNTED HOSE REEL

(76) Inventor: Carl L. Leach, 4175 S. Baldwin Rd., Orion, MI (US) 48359

( * ) Notice: Subject to any disclaimer, the term of this patent is extended or adjusted under 35 U.S.C. 154(b) by 0 days.

(21) Appl. No.: 09/804,889

(22) Filed: Mar. 13, 2001

(65) Prior Publication Data

US 2002/0043593 A1 Apr. 18, 2002

Related U.S. Application Data

(60) Provisional application No. 60/188,909, filed on Mar. 13, 2000.

(51) Int. Cl.[7] ..... B05B 15/06
(52) U.S. Cl. ..... 248/75; 248/79
(58) Field of Search ..... 248/75, 79, 80, 248/81, 82, 90; 403/378, 379.3

(56) References Cited

U.S. PATENT DOCUMENTS

| | | | | | |
|---|---|---|---|---|---|
| 4,628,323 | A | * | 12/1986 | Crean | 343/765 |
| 4,648,734 | A | * | 3/1987 | Daus, Jr. et al. | 403/170 |
| 4,652,890 | A | * | 3/1987 | Crean | 343/822 |
| 4,792,168 | A | * | 12/1988 | Kardosh | 292/288 |
| 4,793,376 | A | | 12/1988 | Hare | 137/355.23 |
| 5,205,521 | A | | 4/1993 | Smith | 248/87 |
| 5,390,695 | A | | 2/1995 | Howard | 137/355.27 |
| 5,515,655 | A | * | 5/1996 | Hoffmann | 52/126.6 |
| 6,314,976 | B1 | * | 11/2001 | Clarke | 135/28 |

* cited by examiner

*Primary Examiner*—Ramon O. Ramirez
*Assistant Examiner*—Kofi Schulterbrandt
(74) *Attorney, Agent, or Firm*—Charles W. Chandler

(57) ABSTRACT

A hose reel is mount on a post so as to be rotatable about a vertical axis.

5 Claims, 2 Drawing Sheets

POST MOUNTED HOSE REEL

This application claims the benefit of provisional application No. 60/188,909, filed Mar. 13, 2000.

BACKGROUND OF THE INVENTION

This invention is related to a post for supporting a conventional wall-mounted hose reel such that the hose can be unwound in any selected direction from the post.

Hose reels are commonly used for winding up a garden hose when it is not being used. Some hose reels are adapted to be mounted on a vertical wall, above the ground. However, in some cases a wall is not available. It is inconvenient to mount the hose reel on the ground.

Examples of hose reels adapted for mounting in a raised position above the ground include U.S. Pat. No. 4,793,376 issued Dec. 27, 1988 to Larry L. Hare for "Portable, Recoilable Hose System"; U.S. Pat. No. 5,205,521 issued Apr. 27, 1993 to John H. Smith for "Hose Reel Stand with Pivot Means"; and U.S. Pat. No. 5,390,695 issued Feb. 21, 1995 to Gary B. Howard for "Reel Assembly for Hose".

The broad purpose of the present invention is to provide an improved hose reel support for mounting a conventional wall-mounted hose reel on a post, in such a manner that the reel can be unwound in any selected horizontal direction from the reel location. Alternatively, the user can remove the hose reel from the post and mount it on a wall.

The preferred embodiment of the invention comprises a post having a base about 22" in diameter. Other embodiments of the invention include a permanently mounted post embedded in the ground; and a screw-in post tip for soft soil. A vertical post about 48" high extends upwardly from the center of the base. A collar is attached around the post about 33" from the base. A metal sleeve is telescopically mounted on the upper end of the post and rests on the collar. A locking device permits the sleeve to be locked in a selected position around the vertical axis of the-post. The sleeve has a pair of horizontal, spaced, parallel apertured arms for attaching the hose reel.

The preferred embodiment permits the reel to be mounted in a suitable position above the ground, to be unwound in a selected direction about the post, and permits the reel to be mounted either on the post or on a wall support.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
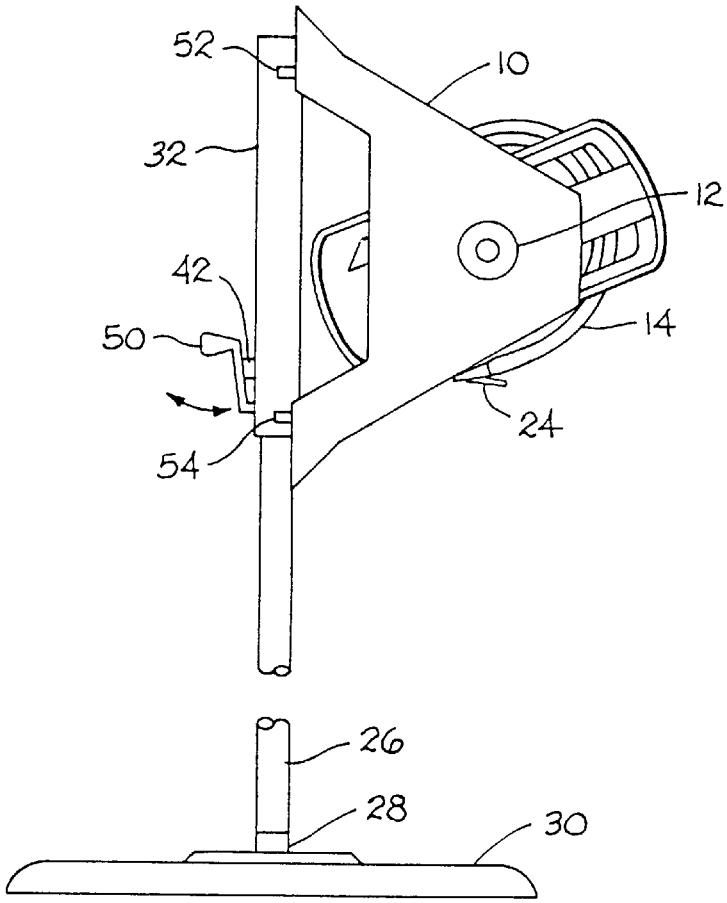
FIG. 1 is an elevational view of a wall-mountable hose reel mounted on a post in accordance with the invention.
Figure 2:
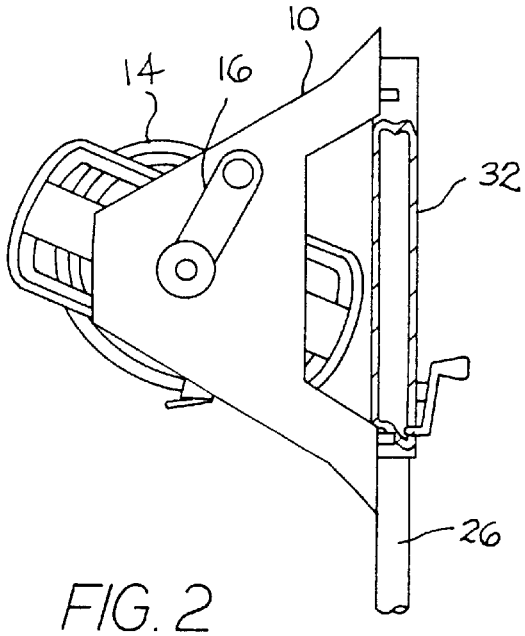
FIG. 2 is a view from the opposite side of FIG. 1.
Figure 3:
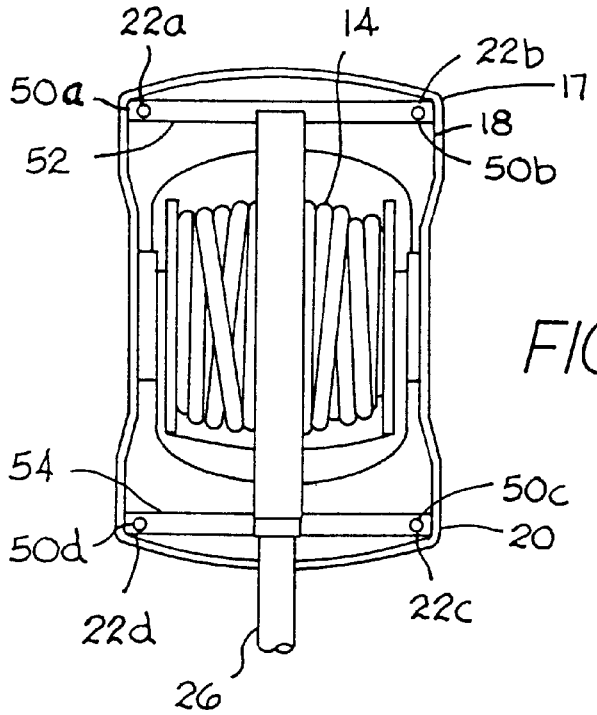
FIG. 3 is a rear view as seen from the right side of FIG. 2.

FIG. 1 illustrates a conventional wall-mountable bracket 10 having a reel 12 for mounting a garden hose 14. As illustrated in FIG. 2, a handle 16 is connected to the reel for rotating it in one direction for winding up the hose or in the opposite direction for unwinding the hose from the reel. The hose reel includes a base 17, as illustrated in FIG. 3 having a pair of apertured feet 18 and 20 for receiving a fastener at each of the four corners illustrated at 22*a*, 22*b*, 22*c*, and 22*d* for mounting the reel in a raised position on a wall, not shown.

Such a hose reel is available from Suncast Corp. or Ames Lawn and Garden Tools.

The hose has a conventional nozzle 24, used for releasing pressurized water.

A vertical post 26 is about 48" tall and has a 1⅞" inch outside diameter. The post has a lower end attached at 28 to a circular, metal, relatively heavy base 30, which is about 22" in diameter. The base thus provides a stable means for supporting the post in an upright position.

A tubular metal sleeve 32 having an inside diameter slightly larger than the is outside diameter of the post is telescopically mounted on the upper end of the post.

A collar 34 is attached to an intermediate position of the post, preferably about 33" above the base, however, this height can be varied depending upon the size of the hose reel.

The lower end of the sleeve is slidably seated on collar 34. The post has an annular array of openings 36 located about ¾" above collar 34. Sleeve 32 has an opening 38, aligned with a selected one of apertures 36 by swinging the sleeve and the hose reel about the longitudinal vertical axis of the post.

Figure 4:
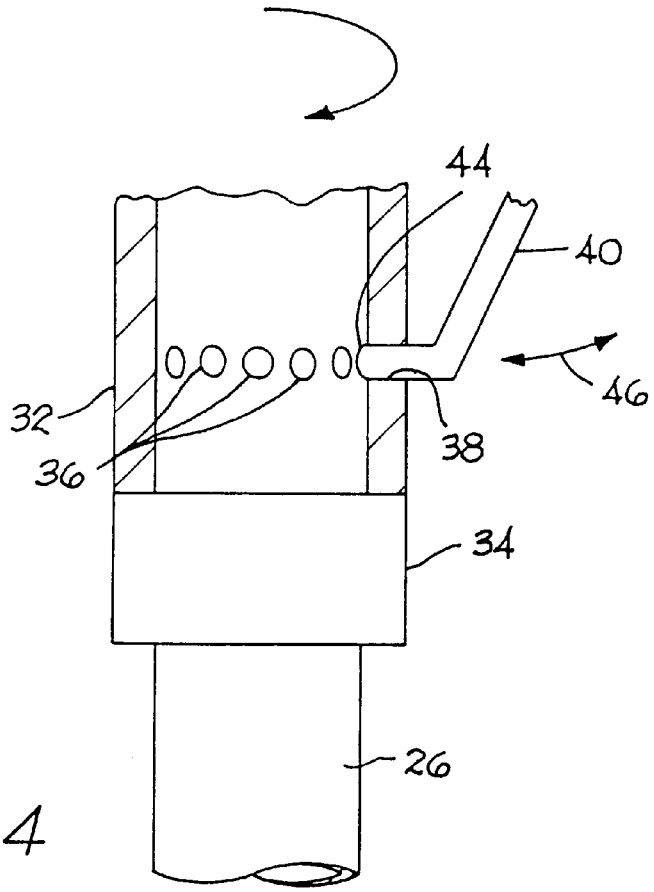
FIG. 4 is an enlarged view showing the mechanism for locking the sleeve on the post.

Referring to FIGS. 1 and 4, a locking pin 40 is pivotally mounted on a support means 42, attached to the sleeve. The locking pin has an arm about 2½" long pivotally mounted on a support means to a nose 44 so that the pin can be pivoted in the direction of arrows 46 into and out of opening 38 and a selected aperture 36. A handle 50 on the opposite end of the locking pin permits the user to swing the pin away from the post in order to adjust the position of the sleeve on the post, and then to lock the sleeve in position by pivoting and inserting nose 44 into a selected aperture 36.

Referring to FIGS. 1 and 3, a pair of horizontal arms 52 and 54, each formed of a fabricated steel angle, are attached to the sleeve, preferably by having a horizontal portion of each angle inserted in a slot in the sleeve and then welded in position. Each arm is a 1" angle having a length of about 14¼". The vertical distance between the two arms is 17¼". The angles are apertured for receiving locking fasteners 50*a*, 50*b*, 50*c*, and 50*d* through the feet of the real base.

Thus, it is to be understood that I have described a reel mounting apparatus for supporting a conventional wall-mounted hose reel on a post. The hose reel may be disposed for unwinding the hose in a selected direction about the post. Alternatively, the reel base can be removed from the post and mounted in the conventional manner on a vertical wall.

Having described my invention, I claim:

1. A hose reel stand for supporting a hose reel having a length of hose wound thereon, comprising:

a hose reel;

a support post having a longitudinal axis, the post having a lower end adapted to support the post and the reel on a ground surface, and an upper end;

a collar mounted on the support post in an intermediate position between said upper end and said lower end thereof, a longitudinally spaced distance beneath the upper end of the support post;

a sleeve and means for attaching the hose reel to the sleeve, the sleeve having an inner diameter greater than the outer diameter of the support post to permit the sleeve to be telescopically received thereon, the sleeve having a lower end with a diameter less than the outer diameter of the collar such that the collar supports the sleeve in a position aligned with the longitudinal axis of the post;

the attachment means comprising a wall mountable bracket;

the hose reel being mounted on the bracket;

a handle connected to the reel for rotating the reel in one direction for winding up a hose, or in the opposite direction for unwinding the hose from the reel;

the bracket including a base having feet apertured (18,20) for receiving fastener means for mounting the reel in a raised position on a wall;

arm structure (52,54) attached to the sleeve, said arm structure having arm apertures aligned with the feet apertures on the base;

fasteners received in the feet apertures and the arm apertures for removably connecting the base to the sleeve;

either the sleeve or the post having annularly spaced latch openings formed about the longitudinal axis of the post, the other of the sleeve or the post having at least one aperture alignable with a selected one of the latch openings; and a latch pin movably carried on the sleeve between a locking position in which a portion of the latch pin is received in the aligned aperture and a latch opening, and a release position in which the pin is removed from said latch opening and the aperture to permit the sleeve to be rotated about the axis of the post to a position in which the aperture is aligned with another of the latch openings.

2. A hose reel stand as defined in claim 1, in which the sleeve is slidably rotatably mounted on the collar.

3. A hose reel stand as defined in claim 1, in which the latch opening is carried on the post above the collar.

4. A hose reel stand as defined in claim 1, including means for pivotally supporting the latch pin on the sleeve.

5. A hose reel stand as defined claim 1, in which the hose reel is rotatable about an axis at right angles to the longitudinal axis of the sleeve.

* * * * *